US005775404A

United States Patent [19]

Miki et al.

[11] Patent Number: 5,775,404

[45] Date of Patent: Jul. 7, 1998

[54] METHOD OF CONTINUOUSLY CASTING AUSTENITIC STAINLESS STEEL

[75] Inventors: Yuji Miki; Seiji Itoyama; Nagayasu Bessho; Sumio Yamada; Hiroshi Nomura, all of Chiba, Japan

[73] Assignee: Kawasaki Steel Corporation, Kobe, Japan

[21] Appl. No.: 704,591

[22] PCT Filed: Feb. 9, 1996

[86] PCT No.: PCT/JP96/00281

§ 371 Date: Sep. 16, 1996

§ 102(e) Date: Sep. 16, 1996

[87] PCT Pub. No.: WO96/24452

PCT Pub. Date: Aug. 15, 1996

[30] Foreign Application Priority Data

Feb. 9, 1995 [JP] Japan ..... 7-021659

[51] Int. Cl.[6] ..... B22D 11/00

[52] U.S. Cl. ..... 164/477; 164/479; 164/481; 164/489

[58] Field of Search ..... 164/459, 477, 164/428, 429, 479, 481, 489

[56] References Cited

U.S. PATENT DOCUMENTS 4,883,544 11/1989 Ueda et al. ..... 164/476

FOREIGN PATENT DOCUMENTS 5326203 8/1978 Japan .
2182353 7/1990 Japan .
342150 2/1991 Japan .
3114638 5/1991 Japan .

*Primary Examiner*—Joseph J. Hail, III
*Assistant Examiner*—L.-H. Lin
*Attorney, Agent, or Firm*—Dvorak & Orum

[57] ABSTRACT

This invention proposes a continuous casting method for austenitic stainless steel capable of simultaneously establishing productivity and an excellent surface quality of steel sheet. For this purpose, the invention lies in a method of continuously casting austenitic stainless steel by pouring melt of austenitic stainless steel from a tundish through an immersion nozzle into a continuously casting mold of a continuous slab caster, solidifying it in the mold and continually drawing the resulting slab of given size out from the mold, characterized in that a high-speed continuous casting is carried out so as to satisfy a relation of casting speed, superheating degree of molten steel in the tundish, sectional area of discharge port in the immersion nozzle and slab width represented by the following equation:

$$0.30 \leqq V^{0.58} \cdot W^{-0.04} \cdot \Delta T \cdot d^{-0.96} \leqq 0.85$$

wherein

V: casting speed (m/min)

W: slab width (mm)

ΔT: superheating degree of molten steel in tundish (°C.)

d: square root of sectional area of nozzle discharge port (mm).

4 Claims, 7 Drawing Sheets

METHOD OF CONTINUOUSLY CASTING AUSTENITIC STAINLESS STEEL

CROSS-REFERENCE TO RELATED APPLICATION

This application is a 371 of PCT/JP96/00281 filed Feb. 9 1996 published as WO96/24452 Aug. 15, 1996.

1. Technical Field

This invention relates to a method of continuously casting austenitic stainless steel, and more particularly to a continuously casting method simultaneously establishing prevention of surface defects and high-speed casting.

2. Background Art

In stainless steel sheets, it is strongly demanded to more beautify the sheet surface as compared with the other general-purpose steel sheets from a viewpoint of their applications, so that the reduction of surface defects should simultaneously be attained even in the continuous casting of stainless steel. As the conventional technique for reducing surface defects of austenitic stainless steel sheets, there are well-known a method of controlling a cooling rate over a region ranging from a solids temperature of a surface solidification layer portion up to at least 1200° C. to attain the formation of fine austenite grains as disclosed in JP-A-63-192537, and a method of controlling molten steel components and super heating degree of molten steel to attain the formation of fine austenite grains as disclosed in JP-A-3-42150.

Recently, the demand for product quality becomes increasingly strict. For this end, there is proposed the individual control of cooling rate, superheating degree of molten steel and the like, but it can not be said that such a mere control is sufficient because the surface defects are still created.

On the other hand, it is recently demanded to increase the casting speed even in the continuous casting method from a viewpoint of the improvement of productivity. However, when the casting speed is increased, there is a tendency that the surface defects are apt to be superfluously created. Therefore, if it is intended to increase the casting speed until now, it can not be increased considering the surface quality, and hence it is attempted to select the casting speed to a low level within a sufficient range without making an adequate standard and the improvement of the productivity could not be attained.

DISCLOSURE OF INVENTION

It is, therefore, an object of the invention to favorably solve the aforementioned problems in the continuous casting of austenitic stainless steel and to provide a continuous casting method of austenitic stainless steel capable of simultaneously attaining high productivity and excellent surface quality of steel sheet.

The essential points and construction of the invention are as follows:

A method of continuously casting austenitic stainless steel by pouring melt of austenitic stainless steel from a tundish through an immersion nozzle into a continuously casting mold of a continuous slab caster, solidifying it in the mold and continually drawing the resulting slab of given size out from the mold, characterized in that a high-speed continuous casting is carried out so as to satisfy a relation of casting speed, superheating degree of molten steel in the tundish, sectional area of discharge port in the immersion nozzle and slab width represented by the following equation:

$$0.30 \leqq V^{0.58} \cdot W^{-0.04} \cdot \Delta T \cdot d^{-0.96} \leqq 0.85$$

wherein

V: casting speed (m/min)

W: slab width (mm)

ΔT: superheating degree of molten steel in tundish (°C.)

d: square root of sectional area of nozzle discharge port (mm).

The invention is particularly adaptable when the casting speed V is not less than 1.2 m/min.

Furthermore, according to the invention, when the continuous slab caster is a vertical-type twin belt caster or a block caster for the continuous production of thin slab, the high-speed continuous casting is carried out so as to satisfy a relation represented by the following equation:

$$0.50 \leqq V^{0.58} \cdot W^{-0.04} \cdot \Delta T \cdot d^{-0.96} \leqq 1.40$$

Moreover, the casting speed V of not less than 3.0 m/min is particularly advantageous when the continuous slab caster is the vertical-type twin belt caster or block caster for the continuous production of thin slab.

As the immersion nozzle according to the invention, a multi-hole nozzle is particularly favorable. In case of the multi-hole nozzle, the sectional area of nozzle discharge port means a total sectional area of nozzle openings facing to a short side constituting the mold for the continuous casting (e.g. sectional area of one-side nozzle opening in case of two-hole nozzle, or total sectional area of two hole nozzles facing to the short side of the mold in case of four-hole nozzle).

As a result of the inventors' studies, it has been found out that the formation of fine internal solidification structure of austenite grains in the surface layer portion of the cast slab and the reduction of microsegregation of impurity elements accompanied therewith are important for the improvement of surface properties of the cast slab and hot workability. Furthermore, it has been thought out that since the solidification structure in the austenite grains is dendritic, in order to form the fine solidification structure, it is necessary to control heat input quantity (Qm) from molten steel jetted through the discharge port of the immersion nozzle to initial solidification shell formed just beneath meniscus portion in the mold of the continuous caster.

Moreover, it has been found that the casting speed V, superheating degree of molten steel ΔT, width W of slab and sectional area A of discharge port of immersion nozzle in the mold are important parameters for controlling the heat input quantity Qm. As a result, it has been found that cast slabs having a high quality can be obtained even at a high casting speed by controlling these four parameters so as to satisfy a given relation.

According to studies of Kumada et al (Journal of the Japan Institute of Mechanics, 35 (1969)) and Nakado et al (TETSU-TO-HAGANE, 67(1981), p.1200), the heat input quantity Qm is said to be represented by the following equations:

$$Qm = hm \cdot \Delta T \quad (1)$$

$$hm = 1.42(k/d) \times (Vn \cdot d \cdot \rho/\eta)^{0.58} \times (C \cdot \eta/k)^{0.43} \times (X/d)^{-0.62}$$

wherein hm: heat transfer coefficient, k: thermal conductivity of shell, ρ: density of molten steel, η: viscosity of molten steel, C: specific heat of molten steel, d: nozzle diameter, Vn: flowing rate of molten steel at discharge port, and X: distance between discharge port and collision point.

However, the most part of the parameters in the above equation (1) are unknown as an actual phenomenon in the mold of the continuous caster and can not be applied to the actual caster as they are. The inventors have made studies with respect to the application to the actual continuous caster considering the facts that a relation between the casting speed V and the flowing rate Vn of molten steel at discharge port is V∝Vn (V is proportional to Vn, same as above), a relation between the width W of slab and the flowing rate Vn of molten steel at discharge port is W∝Vn, a relation between the width W of slab and the distance X between discharge port and collision point is W∝X, and the thermal conductivity k of shell, density ρ of molten steel, viscosity η of molten steel and specific heat C of molten steel are constant as a value of property, and found out that the above equation (1) can be rewritten to the following equation (2):

$$qm=V^{0.58}\cdot W^{-0.04}\cdot \Delta T\cdot d^{-0.96} \quad (2)$$

wherein qm: index of heat input quantity, V: casting speed (m/min), W: slab width (mm), ΔT: superheating degree of molten steel in tundish (°C.), and d: square root (mm) of sectional area of nozzle discharge port (one-side of two-hole nozzle).

Thus, a maximum casting speed capable of ensuring a quality of steel sheet in accordance with the superheating degree of molten steel, slab width and sectional area of nozzle discharge port can be grasped by previously determining a maximum value not causing surface defect as the index of heat input quantity qm, whereby the high productivity and high quality can simultaneously be established. Moreover, when the index of heat input quantity qm is too small, the fusion of mold powder is insufficient and hence the adhesion of unfused mold powder to the cast slab is caused to bring about the occurrence of surface defect in the steel sheet. Therefore, the lower limit of heat input quantity is defined from such a viewpoint. The experiment conducted for defining the upper limit and lower limit of the heat input quantity will be described below.

The casting of 18 wt % Cr–8 wt % Ni steel (SUS 304) having a chemical composition shown in Table 1 is carried out under various conditions of immersion nozzle (two-hole nozzle), casting speed, superheating degree of molten steel and slab width shown in Table 2. Moreover, a thickness of the slab is 200 mm. In order to examine the degree of forming fine solidification structure of surface layer portion of slab obtained in this continuous casting, the solidification structure at a depth of 4 mm from the slab surface is inspected to evaluate the formation of fine structure by large and small size of secondary dendrite arm spacing. Thereafter, the cast slab is subjected to hot rolling, cold rolling and pickling to obtain a steel sheet having a thickness of 1.4 mm as a product, which is subjected to visual inspection for the evaluation of surface quality. The surface defects of the steel sheet is examined by this visual inspection to determine the defect occurring ratio. The defect occurring ratio is indexed as a defect occurring index of (length of rejected portion based on the defect)/(full length of steel sheet)×100.

TABLE 1

| Ingredient | C | Si | Mn | P | S |
|---|---|---|---|---|---|
| wt % | 0.04~0.06 | 0.50~0.70 | 0.9~1.6 | 0.02~0.04 | 0.001~0.008 |
| Ingredient | Cr | Ni | O | N | Fe |
| wt % | 18.0~19.0 | 9.0~10.0 | 0.002~0.606 | 0.015~0.045 | bal. |

TABLE 2

| | | |
|---|---|---|
| Immersion nozzle in mold | Sectional area of one-side discharge port ($mm^2$) | 2500~5000 |
| | Discharging angle (°) | 35 downward~10 upward |
| Casting speed (m/min) | | 0.6~1.6 |
| Superheating degree of molten steel (°C.) | | 10~80 |
| Slab width (mm) | | 700~1300 |

The experimental results to the secondary dendrite arm spacing of the continuously cast slab are graphed in FIGS. 2–5 by using each of superheating degree ΔT of molten steel, casting speed V, slab width W and sectional area A of nozzle discharge port (sectional area per one hole in two-hole nozzle) as a parameter. As seen from FIGS. 2–5, the secondary dendrite arm spacing tends to become large with the increases of the superheating degree ΔT, casting speed V and slab width W and the decrease of sectional area A of nozzle discharge port. As seen from a relation between the casting speed V and the secondary dendrite arm spacing (FIG. 3), the scattering is particularly large because the slab width, superheating degree of molten steel and the diameter of discharge port in the immersion nozzle differ, so that each of these parameters can not be used as an indication for the fine formation of austenite grain and hence an indication of surface quality.

Now, the index of heat input quantity qm shown by the above equation (2) is calculated every the casting condition, from which a relation between the index of heat input quantity qm and the secondary dendrite arm spacing is graphed to obtain results as shown in. FIG. 6. From this figure, it is clear that the index of heat input quantity qm has a strong interrelation to the secondary dendrite arm spacing at 2–4 mm beneath the slab surface substantially corresponding to a surface defect depth of a rolled sheet product. Furthermore, results to a relation between the index of heat input quantity qm and the occurring ratio of surface defect are shown in FIG. 1. From FIG. 1, it is also clear that the index of heat input quantity qm has a strong interrelation to the surface defect occurring ratio of the product and steel sheets having a good quality are obtained when the index of heat input quantity qm is not more than 0.85. That is, when the index of heat input quantity qm is not more than 0.85, the secondary dendrite arm spacing at a position of 4 mm from the surface is not more than 30 μm as seen from FIG. 6, and further when the index of heat input quantity qm is not more than 0.6, the secondary dendrite arm spacing is not more than 25 μm, whereby the occurrence of surface defect is more mitigated.

On the other hand, when the heat input quantity in the vicinity of meniscus is too small and hence the index of heat input quantity qm is less than 0.30, the adhesion of mold powder is caused due to infusion of the powder as previously mentioned to create the defects in the steel sheet as shown in FIG. 1. Therefore, it is necessary that the index of heat input quantity qm defined by the equation (2) is not less than 0.30 in view of the quality insurance.

In the casting method according to the invention, even when the high-speed casting is carried out at a casting speed of not less than 1.2 m/min, further not less than 3.0 m/min, the occurrence of surface defects can be prevented by optimizing the diameter of nozzle discharge port and the superheating degree of molten steel. In the conventional method, if it is intended to conduct the high-speed casting at a casting speed of not less than 1.2 m/min, the index of heat input quantity qm has frequently exceeded 0.85 and hence the surface defect has been created, so that the casting speed could not be enhanced and was about 1.2 m/min at most.

The continuously casting machine used in the invention includes not only general-purpose continuous slab casters but also a vertical type twin belt caster or a block caster for the casting of thin slab having a thickness of 20–100 mm. As disclosed, for example, in KAWASAKI STEEL GIHO, Vol. 21, No. 3(1989) p.175–181, the vertical-type twin belt caster comprises a pair of endless belts arranged apart from each other in correspondence to a thickness of a thin slab to be cast and a casting space defined by a pair of short mold sides disposed on both side ends of the belt and having an upward-extended, downward-contracted shape (upward extending mold), in which molten steel is poured into the upward extending mold through the immersion nozzle and then heat is removed from molten steel by means of cooling pads arranged on the back side of the endless belt to cast a thin slab.

When a slab having a given size is continuously cast by pouring a melt of austenitic stainless steel into the mold of the vertical-type twin belt caster or the block caster through the immersion nozzle and then solidifying it, the high-speed continuous casting can be carried out so as to satisfy a relation of the following equation:

$$0.50 \leqq V^{0.58} \cdot W^{-0.04} \cdot \Delta T \cdot d^{-0.96} \leqq 1.40$$

The continuous casting operation of austenitic stainless steel is carried out by variously changing conditions of superheating degree ΔT of molten steel, casting speed V, slab width W and sectional area A of nozzle discharge port (sectional area per one hole in two-hole nozzle) in the upward extending mold of the vertical-type twin belt caster to obtain results as shown in FIG. 7, from which it is apparent that when these parameters satisfy the condition of $0.50 \leqq V^{0.58} \cdot W^{-0.04} \cdot \Delta T \cdot d^{-0.96} \leqq 1.40$, the surface defect is reduced and the cast slab having a good quality is obtained. In such a continuous casting operation using the upward extending mold of the vertical-type twin belt caster, good surface properties are obtained at a higher casting speed as compared with the continuous casting operation using the general-purpose continuous slab caster. This is considered due to the fact that in case of using the vertical-type twin belt caster, the thickness of the slab is relatively thin and molten steel is rapidly cooled and hence the surface defect hardly occurs even at the higher casting speed. Moreover, when the value of $V^{0.58} \cdot W^{-0.04} \cdot \Delta T \cdot d^{-0.96}$ is less than 0.50, there are caused problems such as false wall, surface matting and the like accompanied with the decrease of molten steel temperature, so that the lower limit of $V^{0.58} \cdot W^{-0.04} \cdot \Delta T \cdot d^{-0.96}$ in case of the continuous caster for the production of thin slab is 0.50.

Thus, it is possible to conduct the high-speed casting at a casting speed V of not less than 3.0 m/min in the continuous casting operation using the vertical-type twin belt caster or block caster.

BEST MODE FOR CARRYING OUT THE INVENTION

EXAMPLE 1

Figure 1:
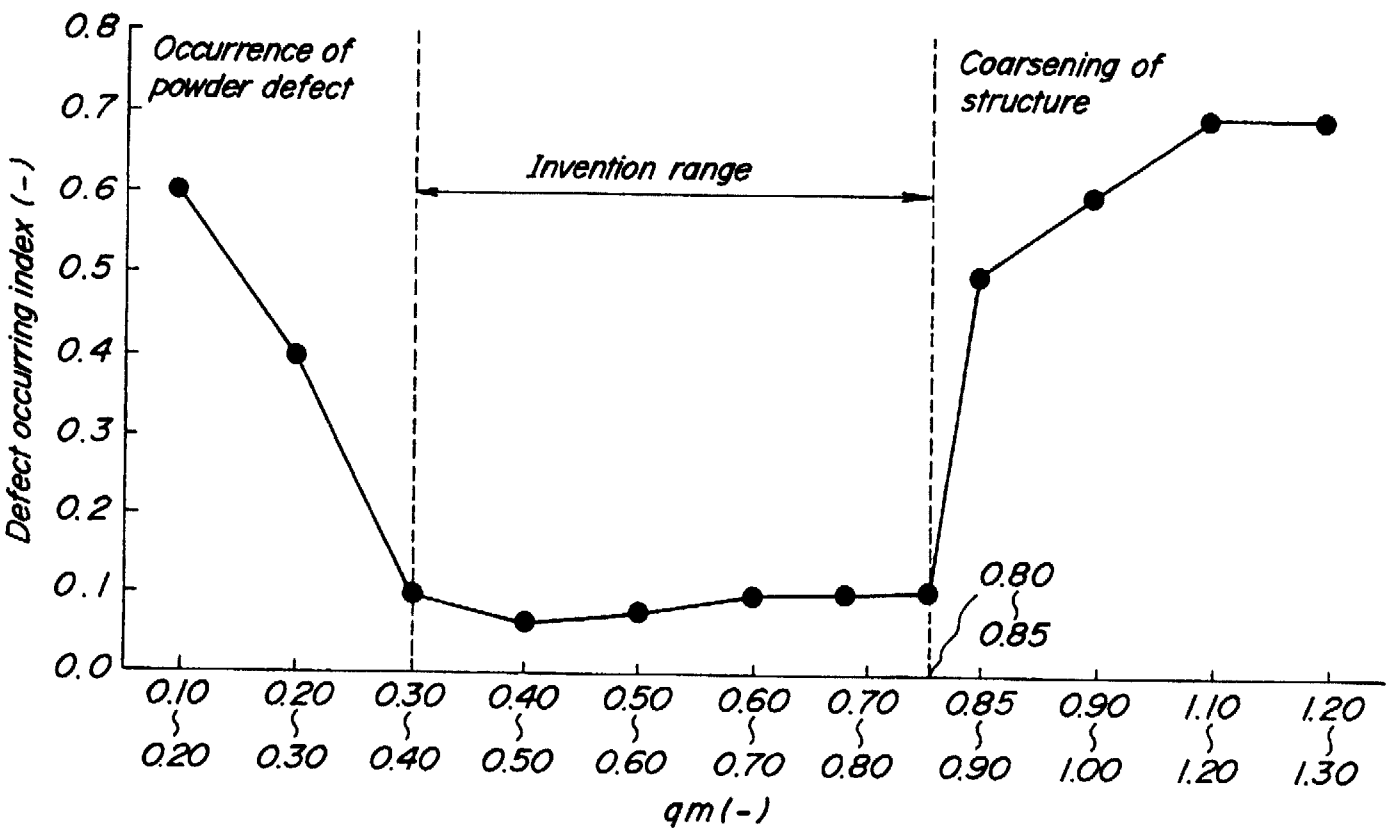
FIG. 1 is a graph showing a relation between index of heat input quantity and surface defect occurring ratio of cold rolled steel sheet.
Figure 2:
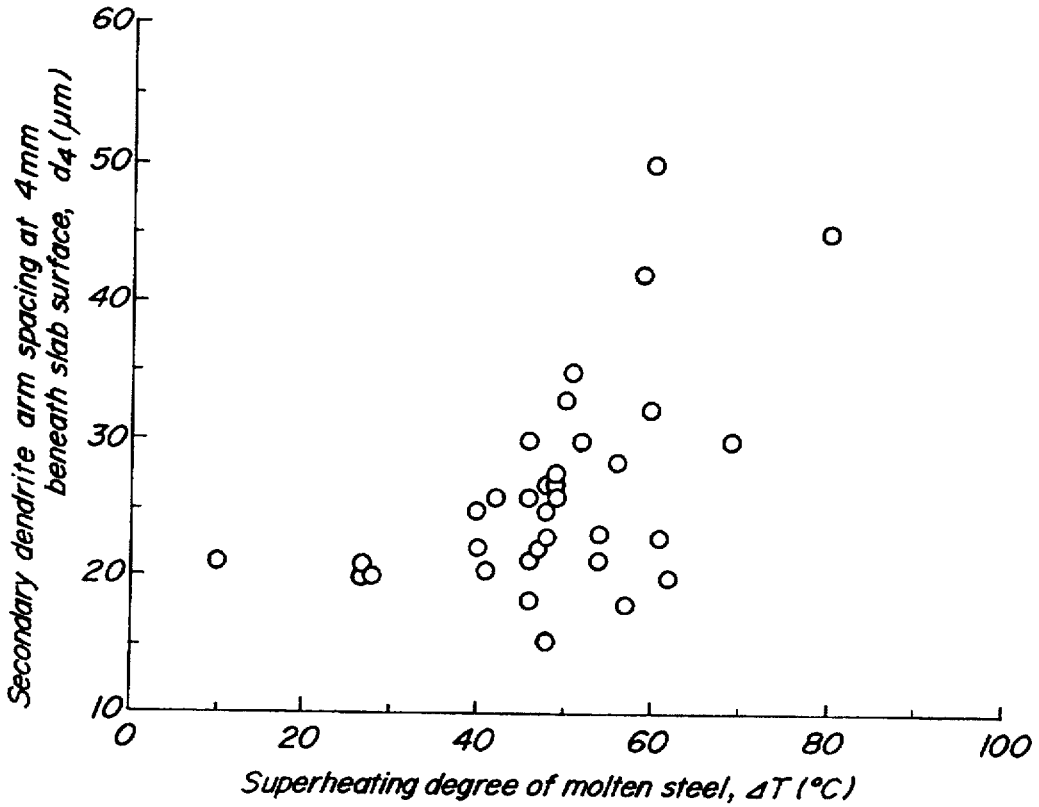
FIG. 2 is a graph showing a relation between superheating degree of molten steel and secondary dendrite arm spacing.
Figure 3:
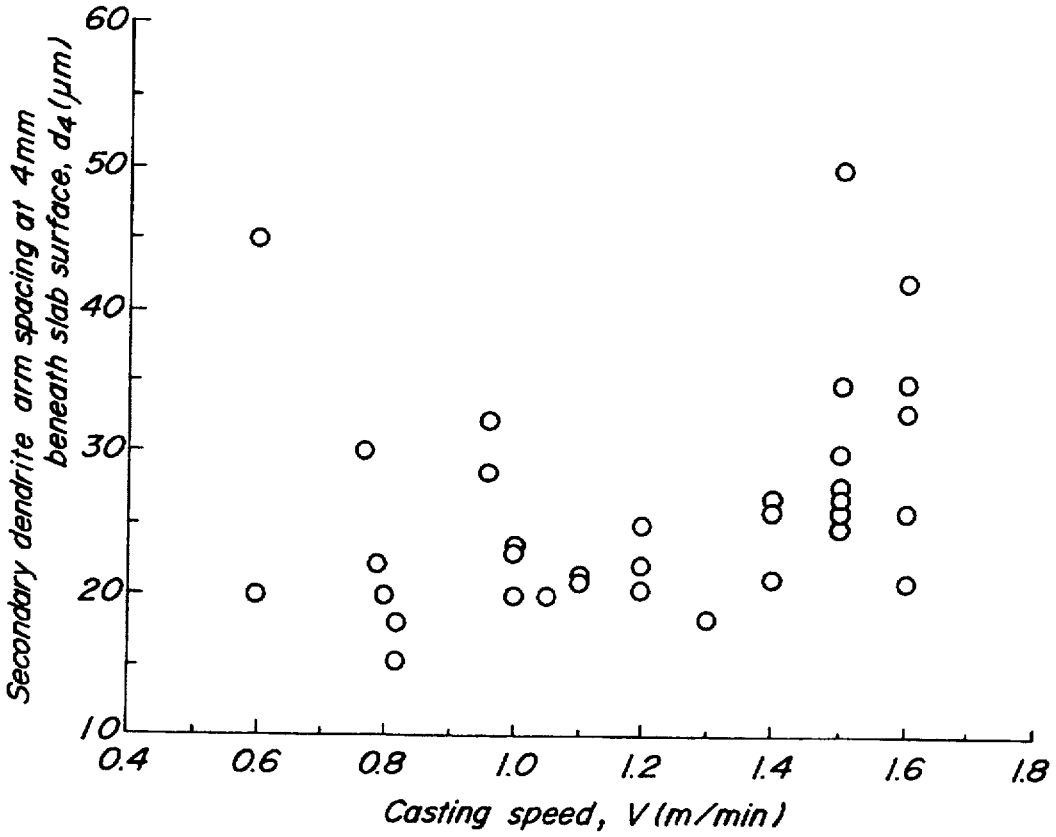
FIG. 3 is a graph showing a relation between casting speed and secondary dendrite arm spacing.
Figure 4:
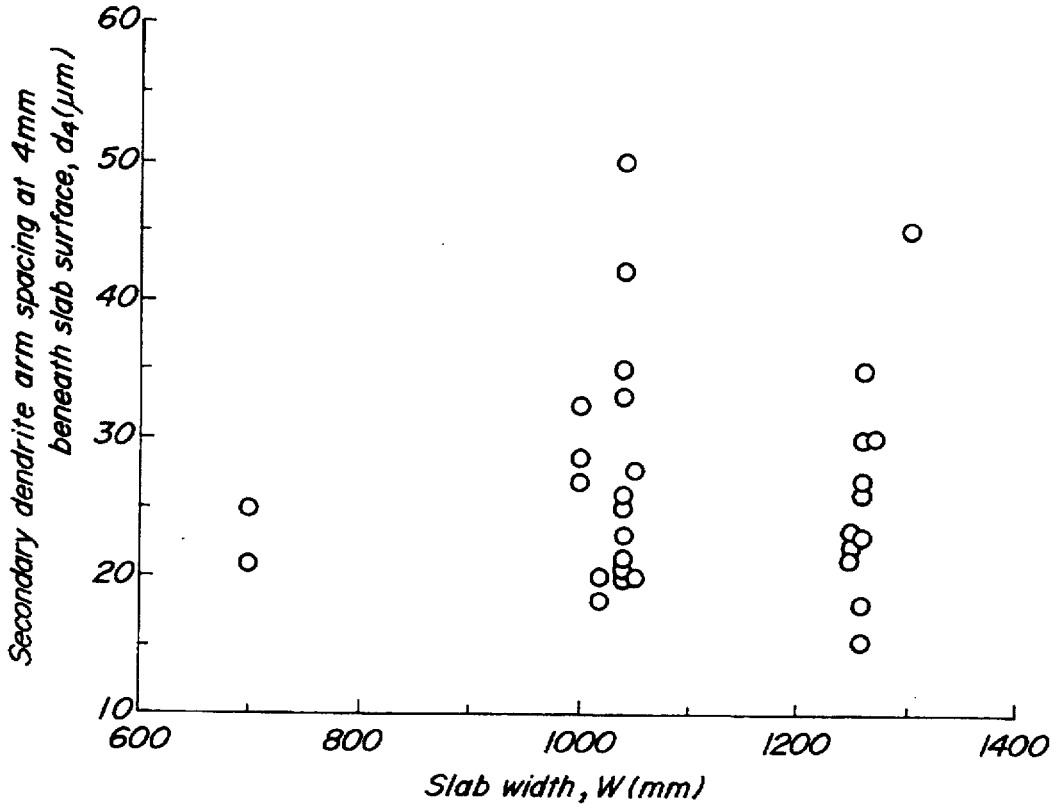
FIG. 4 is a graph showing a relation between slab width and secondary dendrite arm spacing.
Figure 5:
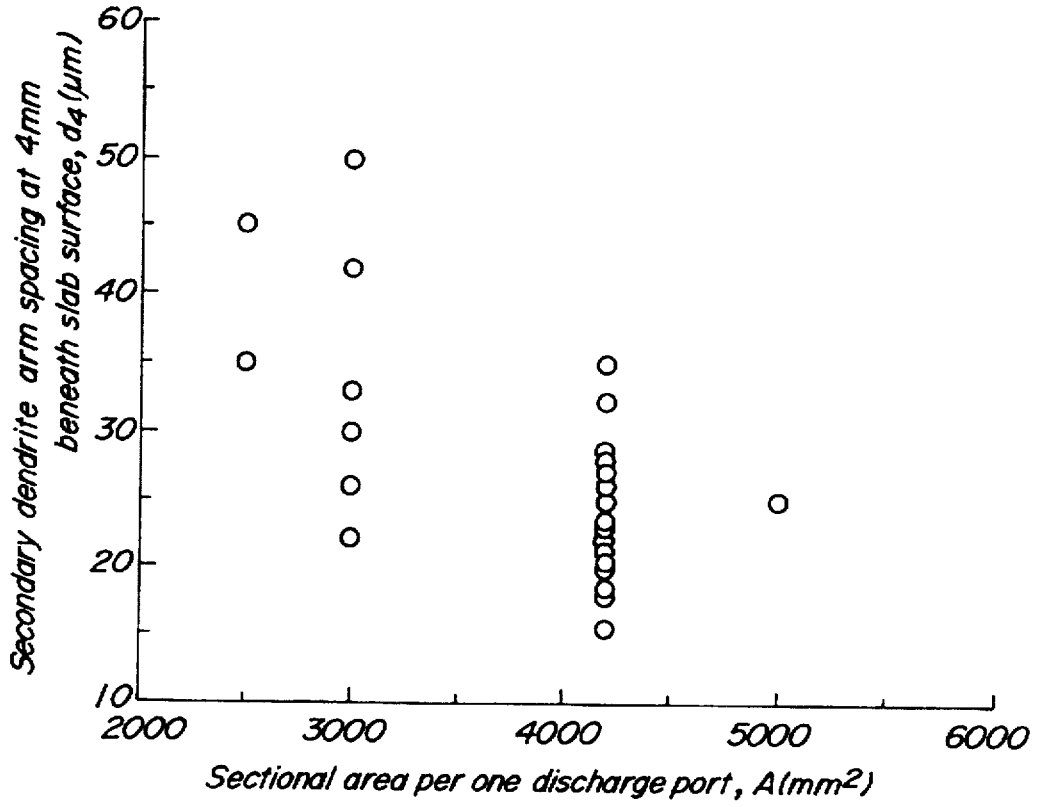
FIG. 5 is a graph showing a relation between sectional area of nozzle discharge port and secondary dendrite arm spacing.
Figure 6:
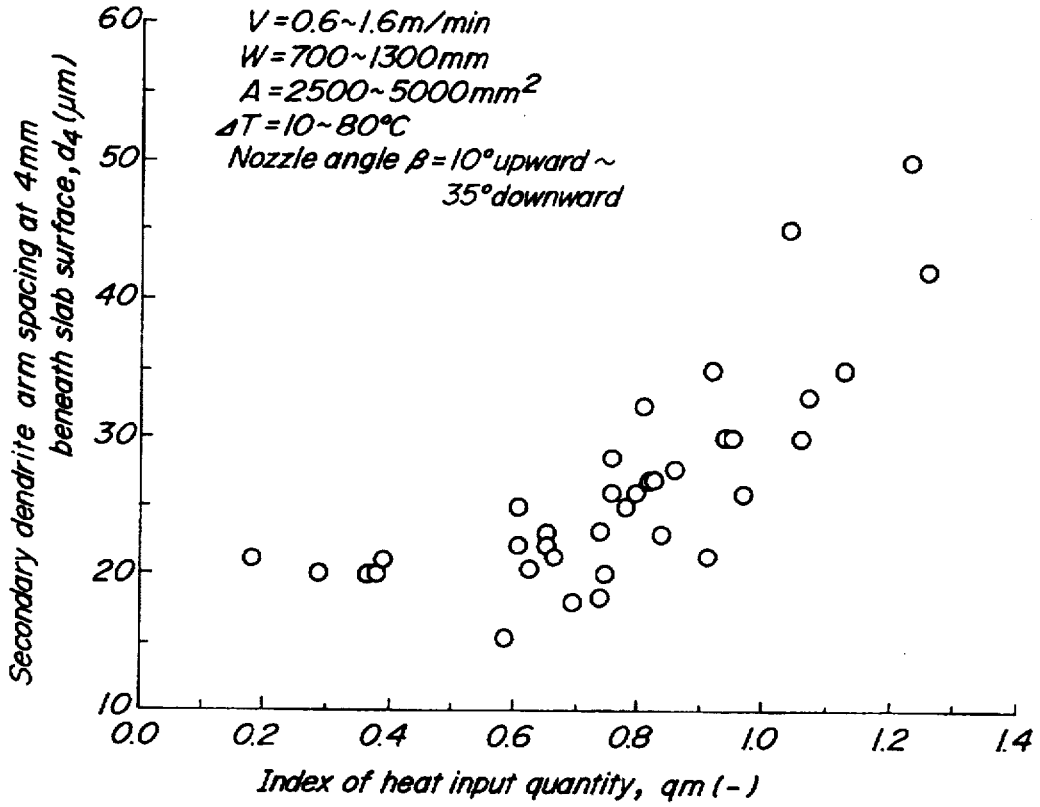
FIG. 6 is a graph showing a relation between index of heat input quantity and secondary dendrite arm spacing.
Figure 7:
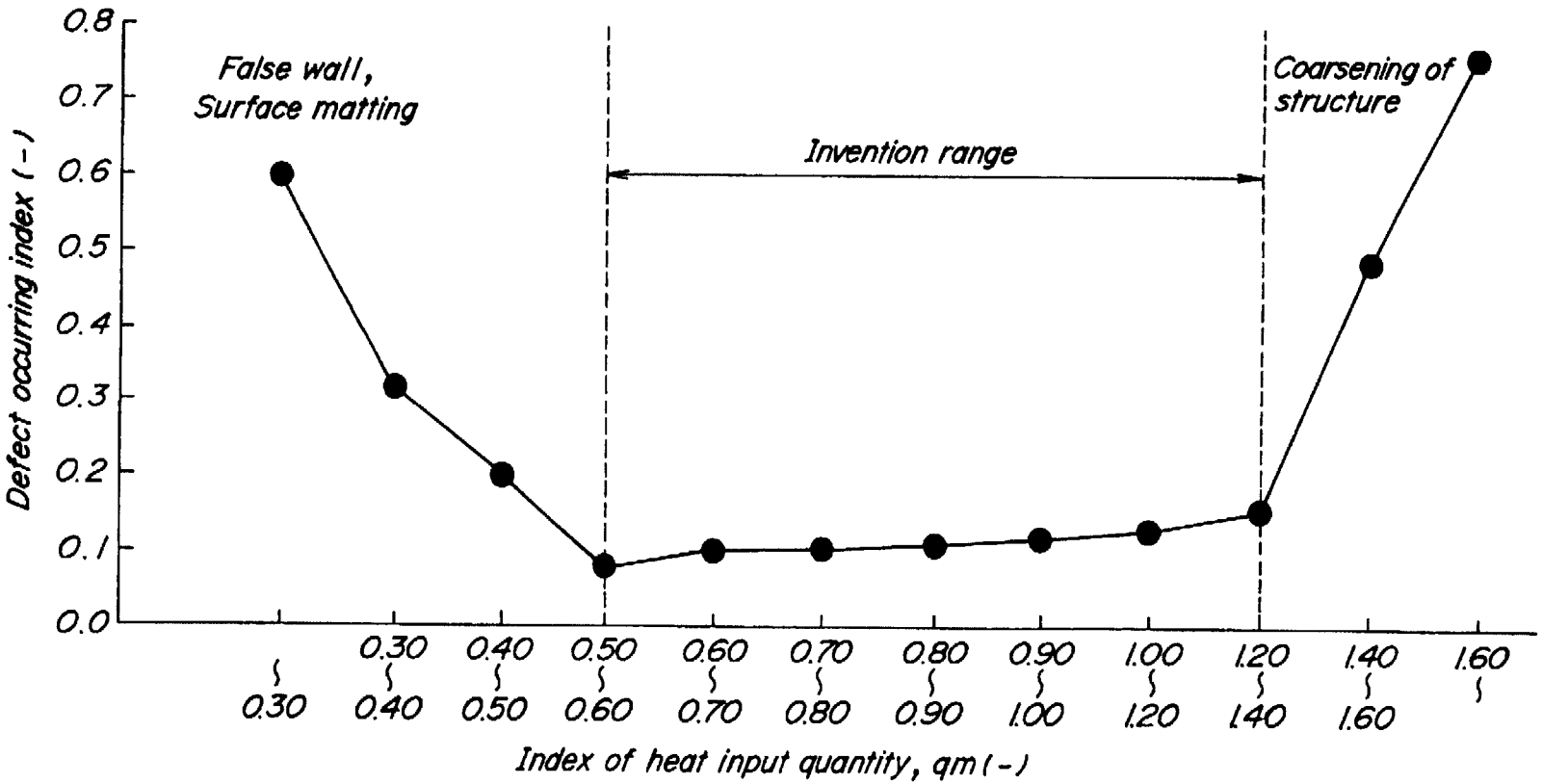
FIG. 7 is a graph showing a relation between index of heat input quantity and surface defect occurring ratio of a cold rolled steel sheet in the continuous casting operation using a twin belt caster.

A continuous casting is carried out by pouring molten steel comprising C: 0.04 wt %, Si: 0.52 wt %, Mn: 0.90 wt %, P: 0.02 wt %, S: 0.003 wt %, Ni: 9.2 wt %, Cr: 18.3 wt % and N: 0.028 wt % and the remainder being iron and inevitable impurities from a tundish through an immersion nozzle into a mold for the continuous casting, solidifying it in the mold and continually drawing out the resulting slab from the mold. In the continuous casting, an superheating degree ΔT of molten steel in the tundish is 48° C., a sectional area of discharge port in the immersion nozzle (two-hole type nozzle, discharging angle: 5° upward) is 4200 $mm^2$ per one hole, a slab width W is 1040 mm, a slab thickness is 200 mm, and a casting speed is 1.0 m/min. When the solidification structure of the resulting slab is inspected at a depth of 4 mm from the slab surface, a secondary dendrite arm spacing is 23 μm. Thereafter, the slab is subjected to hot rolling, cold rolling and pickling according to usual manner to obtain a steel sheet having a thickness of 1.4 mm. As a result of visual inspection on the product, the quality is good (qm=0.66) without surface defect (defect occurring ratio: 0.07).

Comparative Example 1

A slab is formed from molten steel having the same chemical composition as in Example 1 by the continuous casting method. In this case, the superheating degree ΔT of molten steel in the tundish is 28° C., the sectional area of discharge port in the immersion nozzle (two-hole type nozzle, discharging angle: 5° upward) is 4200 $mm^2$ per one hole, the slab width W is 1020 mm, the slab thickness is 200 mm, and the casting speed is 0.6 m/min. The secondary dendrite arm spacing of the resulting slab is 20 μm when the solidification structure of the slab is inspected at a depth of 4 mm from the slab surface. Thereafter, the slab is subjected to hot rolling, cold rolling and pickling according to usual manner to obtain a steel sheet having a thickness of 1.4 mm. As a result of visual inspection on the product, powder defect is caused due to infusion of mold powder and hence the defect occurring ratio is 0.45 (qm=0.28).

Comparative Example 2

A slab is formed from molten steel having the same chemical composition as in Example 1 by the continuous casting method. In this case, the superheating degree ΔT of molten steel in the tundish is 46° C., the sectional area of discharge port in the immersion nozzle (two-hole type nozzle, discharging angle: 50° upward) is 3000 $mm^2$ per one hole, the slab width W is 1260 mm, the slab thickness is 200 mm, and the casting speed is 1.5 m/min. The secondary dendrite arm spacing of the resulting slab is 30 μm when the solidification structure of the slab is inspected at a depth of 4 mm from the slab surface. Thereafter, the slab is subjected to hot rolling, cold rolling and pickling according to usual manner to obtain a steel sheet having a thickness of 1.4 mm. As a result of visual inspection on the product, the structure is coarsened and hence the defect occurring ratio is 0.6 (qm=0.94).

EXAMPLE 2

A continuous casting is carried out by pouring molten steel comprising C: 0.06 wt %, Si: 0.70 wt %, Mn: 1.5 wt %, P: 0.04 wt %, S: 0.008 wt %, Ni: 10.2 wt %, Cr: 19.0 wt % and N: 0.045 wt % and the remainder being iron and inevitable impurities from a tundish through an immersion nozzle into a mold for the continuous casting, solidifying it in the mold and continually drawing out the resulting slab from the mold. In the continuous casting, the superheating degree ΔT of molten steel in the tundish is 46° C., the sectional area of discharge port in the immersion nozzle (two-hole type nozzle, discharging angle: 5° upward) is 4200 mm2 per one hole, the slab width W is 1260 mm, the slab thickness is 200 mm, and the casting speed is 1.5 m/min. When the solidification structure of the resulting slab is inspected at a depth of 4 mm from the slab surface, the secondary dendrite arm spacing is 26 μm. Thereafter, the slab is subjected to hot rolling, cold rolling and pickling according to usual manner to obtain a steel sheet having a thickness of 1.4 mm. As a result of visual inspection on the product, the quality is good (qm=0.80) without surface defect (defect occurring ratio: 0.08).

EXAMPLE 3

A continuous casting is carried out by pouring molten steel having the same chemical composition as in Example 2 from a tundish through an immersion nozzle into a mold for the continuous casting, solidifying it in the mold and continually drawing out the resulting slab from the mold. In the continuous casting, the superheating degree ΔT of molten steel in the tundish is 48° C., the sectional area of discharge port in the immersion nozzle (two-hole type nozzle, discharging angle: 5° upward) is 4200 $mm^2$ per one hole, the slab width W is 1260 mm, the slab thickness is 200 mm, and the casting speed is 1.5 m/min. When the solidification structure of the resulting slab is inspected at a depth of 4 mm from the slab surface, the secondary dendrite arm spacing is 27 μm. Thereafter, the slab is subjected to hot rolling, cold rolling and pickling according to usual manner to obtain a steel sheet having a thickness of 1.4 mm. As a result of visual inspection on the product, the quality is good (qm=0.83) without surface defect (defect occurring ratio: 0.07).

EXAMPLE 4

A continuous casting is carried out by pouring molten steel comprising C: 0.06 wt %, Si: 0.70 wt %, Mn: 1.5 wt %, P: 0.04 wt %, S: 0.008 wt %, Ni: 10.0 wt %, Cr: 19.0 wt % and N: 0.045 wt % and the remainder being iron and inevitable impurities from a tundish through an immersion nozzle into a mold for the continuous casting, solidifying it in the mold and continually drawing out the resulting slab from the mold. In the continuous casting, the superheating degree ΔT of molten steel in the tundish is 45° C., the sectional area of discharge port in the immersion nozzle (two-hole type nozzle, discharging angle: 45° downward) is 2500 $mm_2$ per one hole, the slab width W is 1040 mm, the slab thickness is 200 mm, and the casting speed is 1.6 m/min. When the solidification structure of the resulting slab is inspected at a depth of 4 mm from the slab surface, the secondary dendrite arm spacing is 26 μm. Thereafter, the slab is subjected to hot rolling, cold rolling and pickling according to usual manner to obtain a steel sheet having a thickness of 1.4 mm. As a result of visual inspection on the product, the quality is good (qm=1.04) without surface defect (defect occurring ratio: 0.09).

Comparative Example 3

A continuous casting is carried out by pouring molten steel having the same chemical composition as in Example 2 from a tundish through an immersion nozzle into a mold for the continuous casting, solidifying it in the mold and continually drawing out the resulting slab from the mold. In the continuous casting, the superheating degree ΔT of molten steel in the tundish is 51° C., the sectional area of discharge port in the immersion nozzle (two-hole type nozzle, discharging angle: 10° downward) is 2500 $mm^2$ per one hole, the slab width W is 1260 mm, the slab thickness is 200 mm, and the casting speed is 1.6 m/min. When the solidification structure of the resulting slab is inspected at a depth of 4 mm from the slab surface, the secondary dendrite arm spacing is 35 μm. Thereafter, the slab is subjected to hot rolling, cold rolling and pickling according to usual manner to obtain a steel sheet having a thickness of 1.4 mm. As a result of visual inspection on the product, the structure is coarsened and the defect occurring ratio is 0.71 (qm=1.15).

EXAMPLE 5

A continuous casting is carried out by pouring molten steel comprising C: 0.05 wt %, Si: 0.40 wt %, Mn: 1.05 wt %, P: 0.025 wt %, S: 0.005 wt %, Ni: 8.9 wt %, Cr; 18.0 wt % and N: 0.031 wt % and the remainder being iron and inevitable impurities from a tundish through an immersion nozzle into an upward extending mold of a vertical-type twin belt caster, solidifying it in the mold and continually drawing out the resulting thin slab from the mold. In the continuous casting, the superheating degree ΔT of molten steel in the tundish is 39° C., the sectional area of discharge port in the immersion nozzle (two-hole type nozzle, discharging angle: 60° downward) is 4000 $mm^2$ per one hole, the slab width W is 1700 mm, the slab thickness is 30 mm, and the casting speed is 5.0 m/min. When the solidification structure of the resulting slab is inspected at a depth of 0.5–1.0 mm from the slab surface, the secondary dendrite arm spacing is 23 μm. Thereafter, the slab is subjected to hot rolling, cold rolling and pickling according to usual manner to obtain a steel sheet having a thickness of 1.4 mm. As a result of visual inspection on the product, the quality is good (qm=1.37) without surface defect (defect occurring ratio: 0.09).

Comparative Example 4

A thin slab is formed from molten steel having the same chemical composition as in Example 5 by the continuous casting method. In this case, the superheating degree ΔT of molten steel in the tundish is 40° C., the sectional area of discharge port in the immersion nozzle (two-hole type nozzle, discharging angle: 60° downward) is 3500 $mm^2$ per one hole, the slab width W is 1700 mm, the slab thickness is 30 mm, and the casting speed is 6.0 m/min. The secondary dendrite arm spacing of the resulting slab is 35 μm when the solidification structure of the slab is inspected at a depth of 0.5–1.0 mm from the slab surface. Thereafter, the slab is subjected to hot rolling, cold rolling and pickling according to usual manner to obtain a steel sheet having a thickness of 1.4 mm. As a result of visual inspection on the product, the structure is coarsened and hence the defect occurring ratio is 1.30 (qm=1.67).

INDUSTRIAL APPLICABILITY

When the austenitic stainless steel is continuously cast by the continuous casting method of austenitic stainless steel according to the invention, the casting can be carried out at a maximum casting speed in accordance with a given superheating degree of molten steel while ensuring a high quality, whereby the high quality and high productivity can simultaneously be established.

We claim:

1. A method for high-speed continuous casting of austenitic stainless steel comprises pouring a melt of an austenitic stainless steel into a casting tundish and flowing the melt from the tundish through an immersion nozzle having a discharge port into a mold of a continuous slab caster, forming a cast slab by solidifying the poured melt in the mold and then continually drawing the resulting slab out from the mold, said slab having a predetermined slab width upon exiting said mold, wherein the high-speed continuous casting is carried out by controlling a heat input quantity of the melt cast through said immersion nozzle, said heat input quantity regulated by simultaneous control of the parameters satisfying the following equation of dimensionless value:

$$0.30 \leqq V^{0.58} \cdot W^{-0.04} \cdot \Delta T \cdot d^{-0.96} \leqq 0.85$$

wherein

V: is the casting speed (m/min)

W: is the slab width (mm)

ΔT: is the superheating degree of the molten steel in the tundish (°C.)

d: is the square root of a cross sectional area of the immersion nozzle discharge port (mm).

2. A method of continuously casting austenitic stainless steel according to claim 1, wherein the casting speed V is not less than 1.2 m/min.

3. The method of continuously casting austenitic stainless steel according to claim 1, wherein the continuous slab caster is one of a vertical-type twin belt caster and a block caster for the continuous production of thin slab, and the high-speed continuous casting is carried out by controlling the heat input quantity of the melt cast through said immersion nozzle, said heat input quantity regulated by simultaneous control of the parameters satisfying the following equation of dimensionless value:

$$0.50 \leqq V^{0.58} \cdot W^{-0.04} \cdot \Delta T \cdot d^{-0.96} \leqq 1.40$$

wherein

V: is the casting speed (m/min)

W: is the slab width (mm)

ΔT: is the superheating degree of the molten steel in the tundish (°C.)

d: is the square root of a cross sectional area of the immersion nozzle discharge port (mm).

4. A method of continuously casting austenitic stainless steel according to claim 3, wherein the casting speed V of not less than 3.0 m/min.

* * * * *